United States Patent [19]

Klingler

[11] Patent Number: 4,643,326

[45] Date of Patent: Feb. 17, 1987

[54] DRINKING CUP CONSTRUCTION

[75] Inventor: Josef F. Klingler, Wilmette, Ill.

[73] Assignee: Janler Corporation, Chicago, Ill.

[21] Appl. No.: 737,503

[22] Filed: May 24, 1985

[51] Int. Cl.[4] ..... B65D 25/28

[52] U.S. Cl. ..... 220/94 R; 220/318; 220/375; 229/1.5 B; D7/9; D7/394

[58] Field of Search ..... 215/100 A, 100.5; 220/94 R, 90.2, 90.4, 375, 317, 318; 229/1.5 B, 43; D7/9, 16–20, 39, 42, 393, 394

[56] References Cited

U.S. PATENT DOCUMENTS

| | | | |
|---|---|---|---|
| 332,527 | 12/1885 | Hofer et al. | 220/318 |
| 1,617,213 | 2/1927 | Paugh | 215/100 A |
| 1,920,330 | 8/1933 | Towns | 220/94 R |
| 2,834,533 | 5/1958 | Carew | 229/1.5 B |
| 3,077,286 | 2/1963 | Cornelius | 215/100 A |
| 3,137,423 | 6/1964 | Tupper | 215/100 A |
| 3,261,635 | 7/1966 | Talay | 215/100 A |
| 3,416,701 | 12/1968 | Kramer et al. | 220/318 |
| 3,456,864 | 7/1969 | Trombley et al. | 220/94 R |
| 3,980,202 | 9/1976 | Monyak et al. | 220/375 |
| 4,331,255 | 5/1982 | Fournier | 220/90.4 |
| 4,555,034 | 11/1985 | Gerhards | 220/94 R |

FOREIGN PATENT DOCUMENTS

| | | | |
|---|---|---|---|
| 109965 | 8/1968 | Denmark | 220/317 |
| 126181 | 11/1984 | European Pat. Off. | 215/100 A |
| 140003 | 4/1903 | Fed. Rep. of Germany | 215/100 A |
| 1554738 | 12/1968 | France | 220/94 R |
| 208164 | 4/1940 | Switzerland | 220/94 R |
| 9122 | of 1905 | United Kingdom | 220/318 |
| 384939 | 12/1932 | United Kingdom | D7/9 |
| 444421 | 3/1936 | United Kingdom | 220/94 R |
| 611277 | 10/1948 | United Kingdom | 220/94 R |
| 956410 | 4/1964 | United Kingdom | 220/94 R |
| 976986 | 12/1964 | United Kingdom | 215/100 A |

*Primary Examiner*—William Price
*Assistant Examiner*—Gary E. Elkins
*Attorney, Agent, or Firm*—Wood, Dalton, Phillips, Mason & Rowe

[57] ABSTRACT

A cup-shaped container formed of a molded synthetic resin. A handle is removably secured to a connector portion of the container, with the connection therebetween being constructed to cause an increase in the connection force as a result of weight of liquid placed in the container when the handle is supported as by a person using the container as a drinking cup. In one embodiment, the invention utilizes a closure having frictional engagement with an upper edge portion of the container for selectively closing the same. A connector between the closure and the handle provides an increase in the connection force as a result of the closure being secured to the container edge portion.

25 Claims, 6 Drawing Figures

FIG. 1
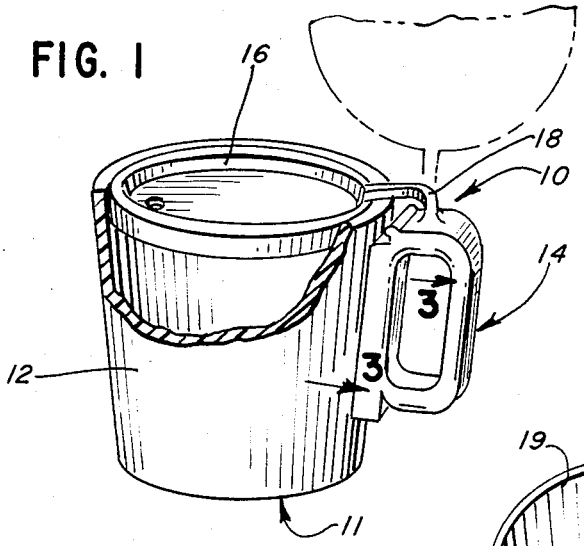
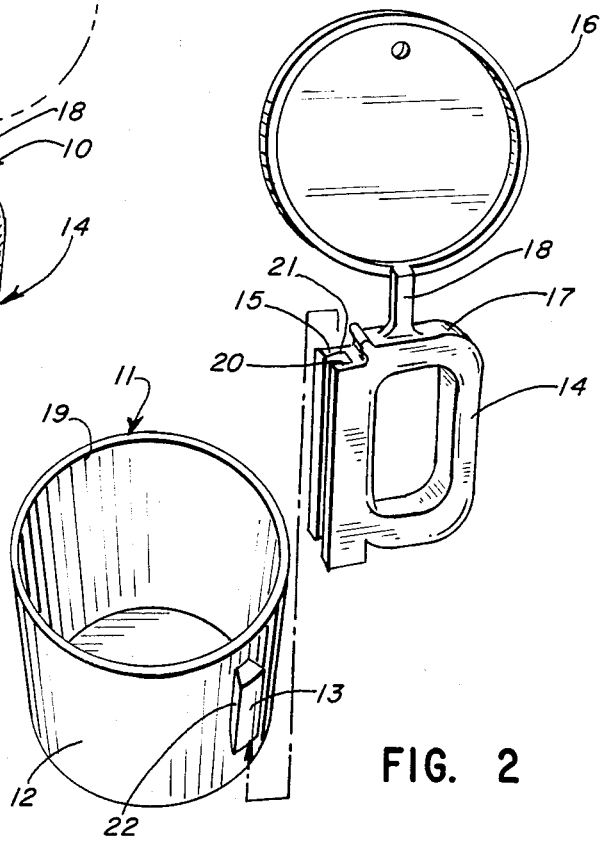
FIG. 2
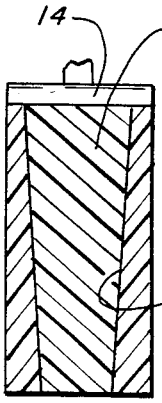
FIG. 3
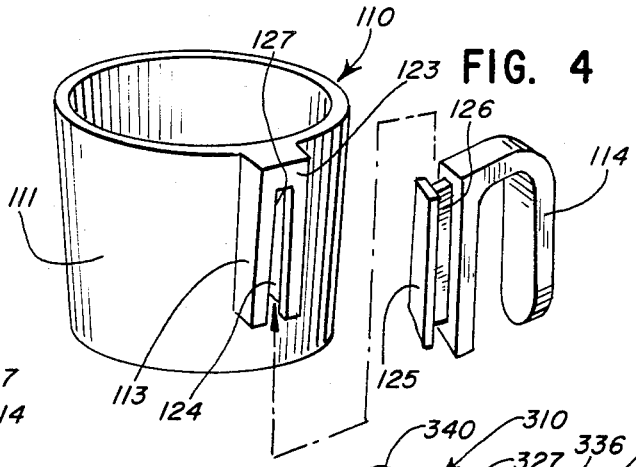
FIG. 4
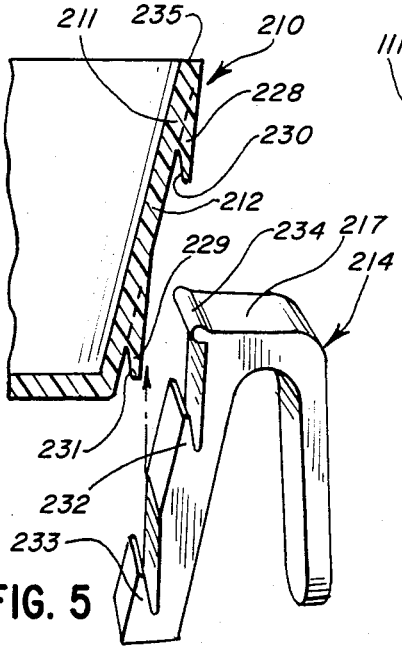
FIG. 5
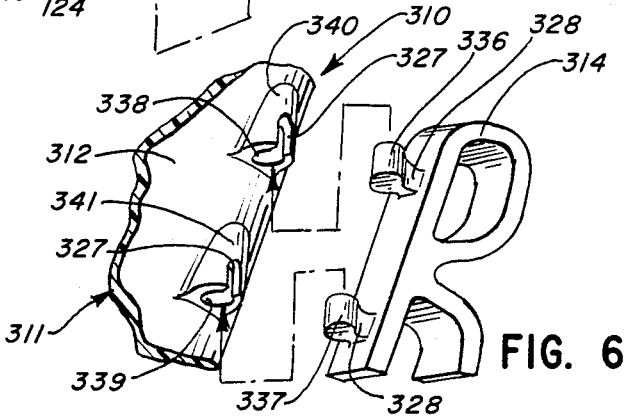
FIG. 6

DRINKING CUP CONSTRUCTION

TECHNICAL FIELD

This invention relates to drinking cup constructions and in particular to the construction of drinking cups having selectively removable handles and drinking cups having selectively removably closures for effectively retaining liquid therein.

BACKGROUND ART

It is conventional to provide drinking cups for coffee and the like, such as for use in automobiles, with removable closures to prevent splashing of the liquid contents from the cup as from motion of the vehicle.

It is further conventional to provide drinking cups having removable handles.

DISCLOSURE OF INVENTION

The present invention comprehends an improved drinking cup construction having a molded cup-shaped container having a sidewall portion provided with integral connector means configured to permit removal of the molded container from a rigid mold in which it is molded. A handle having an integral connection configured to be removably connected to the connector means, with a variable connector force, is constructed to cause an increase in the connection force as a result of weight of liquid placed in the container, with the handle being supported as by a person drinking the liquid from the cup.

The invention further comprehends the provision in such a drinking cup of a closure for frictional engagement with the upper edge portion of the container portion of the cup for selectively closing the cup.

The closure is connected to the handle by connecting means which defines means for causing an increase in the connection force as a result of the closure being secured to the distal upper edge portion of the container.

The closure may be formed integrally with the handle so as to permit the handle and closure to be removed as a unit from a maintained rigid mold in which the connected closure and handle are molded.

In the illustrated embodiment, the closure extends perpendicularly to the plane of the upper distal edge of the container when the closure is disengaged from the container.

The closure is connected to an upper portion of the handle by a resilient connection which may be formed integrally with the handle of synthetic resin.

The connection is both twistable and bendable so as to provide the desired selective positioning thereof and implemented detention force, as discussed above.

The invention comprehends the provision of a number of different configurations of the connecting means within the broad scope of the invention.

The construction of the present invention is extremely simple and economical while yet providing the highly desirable features discussed above.

BRIEF DESCRIPTION OF THE DRAWING

Other features and advantages of the invention will be apparent from the following description taken in connection with the accompanying drawing:

FIG. 1 is a perspective view of a drinking cup embodying the invention, with portions broken away and with the closure shown fragmentarily in broken lines in the released position;

FIG. 2 is a perspective view illustrating the handle disconnected from the container portion of the drinking cup of FIG. 1;

FIG. 3 is a fragmentary enlarged vertical section taken substantially along the line 3—3 of FIG. 1;

FIG. 4 is a perspective exploded view illustrating another form of drinking cup embodying the invention;

FIG. 5 is a perspective view of a handle in association with a container shown in fragmentary section illustrating still another form of drinking cup emboyding the invention; and FIG. 6 is a fragmentary perspective illustrating still another form of drinking cup construction embodying the invention.

BEST MODE OF CARRYING OUT THE INVENTION

In the exemplary embodiment of the invention as disclosed in the drawing, a drinking cup generally designated 10 is shown to comprise a molded cup-shaped container 11 having a sidewall portion 12 provided with integral connector means 13 configured to permit removal of the molded container from a maintained rigid mold in which the container is molded of synthetic resin.

A handle 14 is provided with an in integral connector portion 15 configured to be removably connected to the connector means for the container, with a variable connection force. The connector means and connector portion are constructed to cause an increase in the connection force as a result of weight of a liquid placed in the container, with the handle being supported as by a person drinking the liquid from the cup.

More specifically, the connector means 13 and connector portion 15 of drinking cup 10 comprise cooperating wedging means having a wedging interaction in a preselected wedging direction which, as shown in the illustrated embodiment, is a direction wherein the handle is moved upwardly relative to the container. Thus, weight in the container tends to urge the container downwardly relative to the handle equivalently to the upward displacement of the handle relative to the container.

Not only is the connector portion wedgedly connected to the connector means 13 of the container, but also the connector portion of the handle and connector means of the container are interlocked against displacement of the handle transversely to the wedging direction, i.e. radially away from the sidewall of the container.

In the drinking cup 10, the wedging interlocked connecting means extends substantially the full height of the handle and defines a single such connecting means between the handle and the container.

As best seen in FIG. 2, the connector means 13 defines a trapezoidal projecting rib on the container and the connector portion of the handle defines an undercut keyway.

The connector means 13 and keyway 15 are tapered to narrow upwardly to provide the desired wedging action, as best seen in FIG. 3.

Handle 14 is configured to permit removal of the handle from a maintained rigid mold in which the handle is molded of synthetic resin.

Drinking cup 10 includes, in the illustrated embodiment, a closure 16 which is connected to an upper portion 17 of the handle by means of a connector strap 18. As seen in FIG. 2, the closure extends generally in a planar configuration, which is parallel to the flatwise configuration of the handle so that the handle and closure are effectively configured to permit removal thereof from a maintained rigid mold in which they are molded as a unit.

The connection strap 18 is both twistable and bendable, as seen in FIG. 1, so as to permit the closure 16 to frictionally engage an upper circumferential edge portion 19 of container 11 and be maintained in closing relationship with the container so as to prevent spillage of liquid from the container as by movement of the drinking cup as when used in a moving vehicle or the like.

The connector strap 18 defines means for urging the handle upwardly as a result of the disposition of the closure 16 in secured engagement with the upper portion of the container, thereby augmenting the retention force between the handle and container, and providing a further secure assembly of the drinking cup components in normal use.

The connecting strap 18 is preferably formed unitarily with the handle and closure and of a suitable resilient synthetic resin, permitting the desired twisting and bending thereof.

The undercut recess 20 of the handle connector portion 15 is defined by planar side surfaces 21 complementary to the side surfaces 22 of the container connector means 13.

As illustrated in FIGS. 4, 5 and 6, the invention comprehends modifications of the connecting means of drinking cup 10 within the broad scope of the invention. Illustratively, in the drinking cup construction 110 shown in FIG. 4, the connector means 113 on the container 111 defines a vertically elongated boss 123 having a recess 124 comprising an upwardly narrowing tapered recess for receiving a complementary upwardly narrowing plate 125 connected to the handle by a vertically elongate rib 126 formed integrally and unitarily with the handle 114. The boss 123 is provided with a forwardly opening slot 127 to accommodate the upward movement of the rib 126 therethrough so as to bring the tapered plate 125 into wedged association with the boss 123 in the recess 124.

Thus, the drinking cup 110 functions in a generally similar manner to drinking cup 10, but wherein the male part is provided on the handle and the female part is provided on the container.

Still another modified form of the invention illustrated in FIG. 5 is shown to comprise a drinking cup generally designated 210 wherein the sidewall 212 of the container is provided with a plurality of downwardly projecting vertically spaced flanges 228 and 229 defining, with the sidewall 212, downwardly widening wedge-shaped recesses 230 and 231, respectively.

Handle 214 is provided with a pair of complementary outwardly narrowing flanges 232 and 233, which are frictionally received in the recesses 230 and 231.

In addition to the frictional retention of the wedge-shaped flange and recess structure, the upper portion 217 of the handle is provided with a projecting rib 234 which overlies the upper edge portion 235 of the container 211 to define a snapped retention means releasably retaining the handle 214 to the container, with the flanges 232 and 233 received in the recesses 230 and 231.

Handle 214 is preferably formed as a unit from synthetic resin, having sufficient resiliency to permit the rib 234 to be urged over the upper edge 235 in assembling the handle to the container.

Referring to FIG. 6, still another form of drinking cup generally designated 310 embodying the invention is shown to comprise a plurality of upwardly narrowing dowel portions 336 and 337 on the handle 314, which are received in complementary downwardly opening recesses 338 and 339 in a pair of vertically spaced bosses 340 and 341 formed integrally with the sidewall 312 of the container 311 of the drinking cup 310. The bosses are further provided with outwardly and downwardly opening slots 327 for receiving the connector straps 318 connecting the dowel portions 336 and 337 to the handle 314. The flanges 328 are adapted to pass upwardly through the slots 327 when the dowel-shaped connector portions 336 and 337 are received in the recesses 338 and 339 to connect the handle to the container.

Thus, drinking cups 210 and 310 differ from the drinking cups 10 and 110 in providing a plurality of connecting means between the handle and container, while similarly providing means for increasing the retaining force as a result of liquid being placed in the container as in use of the drinking cup.

The invention comprehends that any of the cups, including cups 110, 210 and 310, as well as cup 10, may be provided with a closure such as the closure 16 of cup 10, providing the supplemental retaining force discussed above relative to cup 10.

The invention comprehends that the container be formed as a single molded element configured to permit removal of the molded element from a substantially rigid mold in which the element is molded. Similarly, the handle is so configured to permit its removal from such a maintained rigid mold. Thus, manufacture of the drinking cup is extremely economical, providing facilitated molding operation, while yet the drinking cup configuration provides an enhanced locking or retention of the handle relative to the container portion of the cup in use.

As discussed above, the closure is connected to the handle by novel means for causing the connecting means to provide an augmentation of the retention force in use when the closure is retained across the open top of the cup.

The foregoing disclosure of specific embodiments is illustrative of the broad inventive concepts comprehended by the invention.

I claim:

1. A drinking cup comprising:

a molded cup-shaped container having a sidewall portion provided with integral connector means configured to permit removal of the molded container from a maintained rigid mold in which it is molded;

a handle having an integral connector portion configured to be removably connected to said connector means with a variable connection force, said connector means and connector portion being constructed to cause an increase in the connection force as a result of weight of liquid placed in the container with the handle being supported as by a person drinking the liquid from the cup; and means operatively associated with a closure for said container and with said handle for increasing the connection force selectively independently of the presence of liquid in the container.

2. The drinking cup of claim 1 wherein said connection means of the container and connector portion of the handle comprise cooperating wedging means having a wedging interaction in a preselected wedging direction.

3. The drinking cup of claim 1 wherein said connection means of the container and connector portion of the handle comprise cooperating wedging means having a wedging interaction in a preselected wedging direction and interlocking means for preventing removal of the connector portion from the connection means transversely to said wedging direction.

4. The drinking cup of claim 1 wherein said connection means of the container and connector portion of the handle comprise a single connection means on said container and a single connector portion on said handle.

5. The drinking cup of claim 1 wherein said connection means of the container and connector portion of the handle comprise a plurality of connection means on said container and a plurality of connector portions on said handle.

6. The drinking cup of claim 1 wherein said connector portion of the handle is formed as an integral portion of the handle unitarily therewith.

7. The drinking cup of claim 1 wherein said container and handle are formed of synthetic resin.

8. The drinking cup of claim 1 wherein said connection means comprises cooperating tapered interlocking key means.

9. The drinking cup of claim 1 wherein said container and handle define cooperating tapered interlocking key means narrowing upwardly.

10. The drinking cup of claim 1 wherein said connection means of the container and connector portion of the handle define a cooperating, upwardly narrowing connection portion and complementary recess in said container sidewall.

11. The drinking cup of claim 1 wherein said connection means of the container and connector portion of the handle define cooperating tapered interlocking key means having frictionally interfitted confronting planar surfaces.

12. The drinking cup of claim 1 wherein said connection means of the container and connector portion of the handle define cooperating tapered interlocking key means having frictionally interfitted confronting rounded surfaces.

13. The drinking cup of claim 1 wherein said connector portion of the handle defines upwardly narrowing tapered dowel means.

14. The drinking cup of claim 1 wherein said connector portion of the handle defines upwardly narrowing tapered dowel means, said handle defines a grasping portion, and further comprises spacer means spacing the dowel means from the handle grasping portion.

15. The drinking cup of claim 1 wherein said handle defines a grasping portion and further comprises means for spacing the connector portion from the grasping portion.

16. A selectively closable drinking cup comprising:

a molded cup-shaped container having a sidewall portion defining an upper circumferential edge portion, and provided with integral connection means configured to permit removal of the molded container from a rigid mold in which it is molded;

a handle having an integral connector portion configured to be removably connected to said connection means with a variable connection force, said connection means and connector portion being constructed to cause an increase in the connection force as a result of weight of liquid placed in the container with the handle being supported as by a person drinking the liquid from the cup;

a closure for frictional engagement with said edge portion for selectively closing the cup; and connecting means connecting the closure to the handle and defining means for causing an increase in the connection force as a result of the closure being secured to said edge portion.

17. The drinking cup of claim 16 wherein said connecting means comprises means defining a resilient connection of the closure to the handle.

18. The drinking cup of claim 16 wherein said handle defines an upper portion and said connecting means comprises means defining a resilient connection of the closure to said upper portion of the handle.

19. The drinking cup of claim 16 wherein said connecting means comprises means defining a resilient connection of the closure to the handle causing the closure to extend perpendicularly to a plane defining the upper distal surface of said upper circumferential edge portion of the container.

20. The drinking cup of claim 16 wherein said connecting means comprises means defining a resilient connection of the closure to the handle causing the closure to extend perpendicularly to a plane defining the upper distal surface of said upper circumferential edge portion of the container, said connecting means comprising a twistable and bendable means formed of synthetic resin.

21. A selectively closable drinking cup comprising:

a molded cup-shaped container having a sidewall portion defining an upper circumferential edge portion and integral connection means on the sidewall portion;

a handle having an integral connector portion configured to be removably connected to said connection means;

a closure for selectively closing the container by extension thereof across the container at said upper edge portion; and connecting means unitarily connecting the closure to the handle, said closure being disposed in any one of a plurality of different positions relative to the container when the handle is retained in fixed association with the container, said handle, closure, and connecting means being unitarily molded of synthetic resin to define a one-piece structure.

22. The drinking cup of claim 21 wherein said connecting means comprises a flexible strap.

23. A selectively closable drinking cup comprising:

a molded cup-shaped container having a sidewall portion defining upper circumferential edge portion and integral connection means on the sidewall portion;

a handle having an integral connector portion configured to be removably connected to said connection means;

a closure for selectively closing the container by extension thereof across the container at said upper edge portion; and connecting means unitarily connecting the closure to the handle, said handle, closure, and connecting means being unitarily molded of synthetic resin to define a one-piece structure, said connecting means being connected to an upper portion of the handle.

24. A selectively closable drinking cup comprising:

a molded cup-shaped container having a sidewall portion defining upper circumferential edge portion and integral connection means on the sidewall portion;

a handle having an integral connector portion configured to be removably connected to said connection means;

a closure for selectively closing the container by extension thereof across the container at said upper edge portion; and connecting means unitarily connecting the closure to the handle, said handle, closure, and connecting means being unitarily molded of synthetic resin to define a one-piece structure, said closure comprising a flat element, and the connecting means causing the closure to extend perpendicularly to the plane of the circumferential edge portion of the container when the closure is released from closing association with the container.

25. A selectively closable drinking cup comprising:

a molded cup-shaped container having a sidewall portion defining upper circumferential edge portion and integral connection means on the sidewall portion;

a handle having an integral connector portion configured to be removably connected to said connection means;

a closure for selectively closing the container by extension thereof across the container at said upper edge portion; and connecting means unitarily connecting the closure to the handle, said handle, closure, and connecting means being unitarily molded of synthetic resin to define a one-piece structure, said connecting means being arranged to urge the connector portion of the handle into maintained association with the connection means on the container.

* * * * *